US007331329B2

(12) United States Patent
Tian et al.

(10) Patent No.: US 7,331,329 B2
(45) Date of Patent: Feb. 19, 2008

(54) FUEL INJECTOR WITH DIRECTLY CONTROLLED HIGHLY EFFICIENT NOZZLE ASSEMBLY AND FUEL SYSTEM USING SAME

(75) Inventors: Steven Y. Tian, Bloomington, IL (US); Scott F. Shafer, Morton, IL (US); Daniel R. Ibrahim, Bloomington, IL (US); Ronald D. Shinogle, Peoria, IL (US); Amy M. Hess, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 529 days.

(21) Appl. No.: 10/195,863

(22) Filed: Jul. 15, 2002

(65) Prior Publication Data

US 2004/0007210 A1 Jan. 15, 2004

(51) Int. Cl.
*F02M 37/04* (2006.01)

(52) U.S. Cl. ..... 123/446; 123/467

(58) Field of Classification Search ..... 123/467, 123/500, 501, 446, 456, 458, 447, 299, 300; 239/88–96

See application file for complete search history.

(56) References Cited

U.S. PATENT DOCUMENTS 4,798,186 A * 1/1989 Ganser ..... 123/467
5,067,658 A * 11/1991 De Matthaeis et al. ..... 239/124
5,156,132 A * 10/1992 Iwanaga ..... 123/496
5,347,970 A * 9/1994 Pape et al. ..... 123/506
5,463,996 A 11/1995 Maley et al.
5,551,398 A 9/1996 Gibson et al.
5,622,152 A * 4/1997 Ishida ..... 123/446
5,628,293 A 5/1997 Gibson et al.
5,673,669 A 10/1997 Maley et al.
5,697,342 A 12/1997 Anderson et al.

(Continued)

FOREIGN PATENT DOCUMENTS

EP 0 976 924 B1 2/2000

OTHER PUBLICATIONS

Bernd Mahr, Manfred Dürnholz, Wilhelm Polach, and Hermann Grieshaber, Robert Bosch GmbH, Heavy Duty Diesel Engines—The Potential of Injection Rate Shaping for Optimizing Emissions and Fuel Consumption Stuttgart, Germany, at the 21st International Engine Symposium, May 4-5, 2000, Vienna, Austria.

*Primary Examiner*—Carl Stuart Miller
(74) *Attorney, Agent, or Firm*—Liell & McNeil

(57) ABSTRACT

Reducing leakage within fuel injectors is one way in which the efficiency of the overall fuel injection system can be improved. In most fuel injectors that include a direct control needle valve, the needle valve member is still biased toward a closed position by a spring that is located in a spring chamber connected to a low pressure vent. In many instances, the needle valve member is guided in a tight clearance region adjacent the spring chamber. Since the internal plumbing of the fuel injector is connected to a high pressure rail during and between injection events, static leakage across the guide region of the needle valve member can reduce efficiency. Static leakage is reduced in the present invention by connecting the spring chamber to the common rail instead of to a low pressure vent. Such a fuel injector could find potential application in any directly controlled fuel injection system, but is particularly applicable in common rail systems in which the fuel injector remains fully pressurized between injection events.

18 Claims, 11 Drawing Sheets

U.S. PATENT DOCUMENTS 5,727,525 A 3/1998 Tsuzuki
5,797,374 A 8/1998 Minagawa et al.
5,860,597 A 1/1999 Tarr
5,873,526 A 2/1999 Cooke
5,899,389 A * 5/1999 Pataki et al. ..... 239/533.2
6,012,644 A 1/2000 Sturman et al.
6,085,727 A 7/2000 Nakano
6,293,254 B1 * 9/2001 Crofts et al. ..... 123/467
6,367,453 B1 4/2002 Igashira et al.
6,371,084 B1 * 4/2002 Betz ..... 123/467
6,499,467 B1 * 12/2002 Morris et al. ..... 123/467
6,539,924 B2 * 4/2003 Ricco ..... 123/490
6,592,050 B2 * 7/2003 Boecking ..... 239/96
6,705,551 B1 * 3/2004 Kienzler et al. ..... 239/533.3
6,725,841 B1 * 4/2004 Boecking ..... 123/467
2003/0201344 A1 * 10/2003 Wark ..... 239/533.8

* cited by examiner

FUEL INJECTOR WITH DIRECTLY CONTROLLED HIGHLY EFFICIENT NOZZLE ASSEMBLY AND FUEL SYSTEM USING SAME

TECHNICAL FIELD

The present invention relates generally to fuel injection systems, and more particularly to fuel injectors with direct control needle valves.

BACKGROUND

Engineers are constantly seeking ways to improve both performance and efficiency in fuel injection systems. Performance improvements can lead to a reduction in undesirable emissions from the engines. Substantial improvements in performance have been achieved by providing fuel injectors with electronically controlled direct control needle valves. In general, a direct control needle valve includes a needle valve member with a closing hydraulic surface that can be exposed to either high pressure or low pressure, independent of engine speed and load. This innovation permits fuel to be injected at timings and in quantities that are electronically controlled independent of engine speed and load. This capability has allowed engineers to tailor engine operation to achieve certain goals, such as a reduction in undesirable emissions from the engine across its operating range. Although the implementation of electronically controlled direct control needle valves has allowed for improved performance, it has often come at the cost of a decrease in efficiency.

Efficiency relates generally to the amount of engine horsepower directed to powering the fuel injection system. One area in which efficiency problems can be revealed relates to the quantity of fluid pressurized by the fuel injection system which but leaked back for recirculation to a low pressure area. In other words, energy is arguably wasted whenever fluid, be it fuel or a hydraulic actuation fluid, is pressurized by an engine operated pump, but leaked back to tank without being used. For instance, in the case of common rail fuel injectors, two major static leakage sources exist, the needle guide and the needle push rod guide. During injector off time, both of these guides are exposed to injection rail pressure on one end with vent to tank pressure on the other end. Extreme measures are often employed to minimize the guide clearance(s) to reduce the static leakage. As the desired operating pressure levels are increased, the leakage problem becomes more and more severe. In addition, pressure induced deflections in the guide bores add to an already difficult situation. During injection, excessive leakage can sometimes occur through the needle control valve that controls the application of high or low pressure to the closing hydraulic surface of the direct control needle valve member. In some instances, the rail is connected directly to drain in order to perform the injection timing control function. While there are often flow restrictions positioned between the rail and the drain, substantial efficiency degradations can occur due to an excessive leakage of fuel back for recirculation in order to perform the control function. For instance, a fuel injection system that exhibits both these static and control leakage issues is described in "Heavy Duty Diesel Engines—The Potential of Injection Rate Shaping for Optimizing Emissions and Fuel Consumption", presented by Messrs Bernd Mahr, Manfred Dürnholz, Wilhelm Polach, and Hermann Grieshaber, Robert Bosch GmbH, Stuttgart, Germany at the 21st International Engine Symposium, May 4-5, 2000, Vienna, Austria.

The present invention is directed problems associated with effectively combining performance and efficiency in fuel injection systems.

SUMMARY OF THE INVENTION

In one aspect, a fuel injector has an injector body that includes a nozzle supply passage in fluid communication with a spring chamber, and a needle control chamber in fluid communication with the nozzle supply passage at least in part via a pressure balancing passage. A direct control needle valve member is moveably positioned in the injector body, and includes a closing hydraulic surface exposed to fluid pressure in the needle control chamber. A spring is operably positioned in the spring chamber to bias the direct control needle valve member toward a closed position. A needle control valve is attached to the injector body and is operable in an off position to expose the closing hydraulic surface to high pressure fuel in the needle control chamber, and operable in an on position to expose the closing hydraulic surface to low pressure fuel in the needle control chamber.

In another aspect, a fuel injection system includes a plurality of fuel injectors fluidly connected to a common rail containing high pressure fuel. Each of the fuel injectors includes a needle control valve, a direct control needle valve member with a closing hydraulic surface, a spring chamber in fluid communication with a high pressure fuel inlet, and a spring operably positioned in the spring chamber to bias the direct control needle valve member toward a closed position. The needle control valve is moveable between a first position at which the closing hydraulic surface is exposed to high pressure and a second position at which the closing hydraulic surface is exposed to low pressure.

In still another aspect, a method of reducing leakage in a common rail fuel injection system includes a step of biasing a needle control valve toward a position that exposes a closing hydraulic surface of a direct control needle valve member to high pressure fuel from a common rail. The direct control needle valve member is biased toward a closed position at least in part by positioning a spring in a spring chamber. The spring chamber is fluidly connected to the common rail.

DETAILED DESCRIPTION

Figure 1:
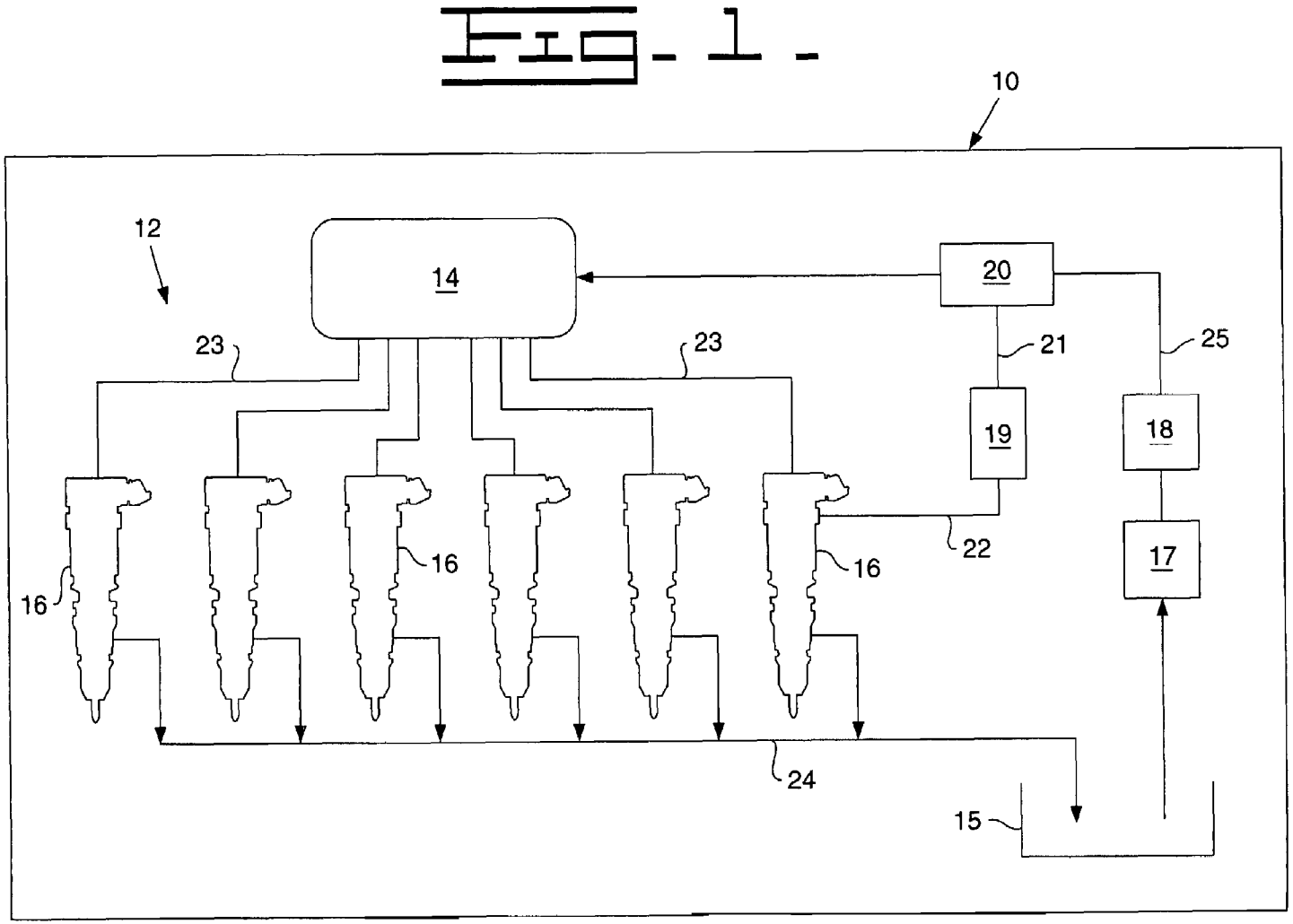
FIG. 1 is a schematic illustration of an engine with a common rail fuel injection system according to one aspect of the present invention.

Referring to FIG. 1, an engine 10 includes a fuel injection system 12, which in the illustrated example is a common rail fuel injection system. Nevertheless, those skilled in the art will appreciate that some aspects of the present invention are applicable to virtually any kind of fuel injection system, including but not limited to hydraulically actuated fuel injection systems, pump and line systems, and cam actuated fuel injection systems. Common rail fuel injection system 12 includes a high pressure common rail 14 containing pressurized fuel, which is connected to a plurality of fuel injectors 16 via separate branch passages 23. Common rail 14 receives pressurized fuel from a high pressure pump 20, which is supplied with low pressure fuel via a supply passage 25. Fuel is circulated to high pressure pump 20 by a transfer pump 18, which draws fuel from fuel tank 15 and filters the fuel in filter 17. Any fuel not injected by injectors 16, such as fuel spilled for a control function, is recirculated to tank 15 via a drain passage 24. The operation of fuel injection system 12 is controlled by a conventional electronic control module 19, which is in communication with fuel injector 16 via communication lines 22 (only one of which is shown) and high pressure pump 20 via a communication line 21. Those skilled in the art will appreciate that the pressure in common rail 14 could be controlled in a number of different manners apart from controlling the output of high pressure pump 20 as in the illustrated embodiment. For instance, pressure in common rail 14 could be controlled by controllably spilling fuel from common rail 14 back to tank 15 in a manner that maintains fuel in rail 14 at some desired pressure commanded by electronic control module 19. Preferably, pump 20 is controlled by matching pump capacity to flow demand requirements.

Figure 2:
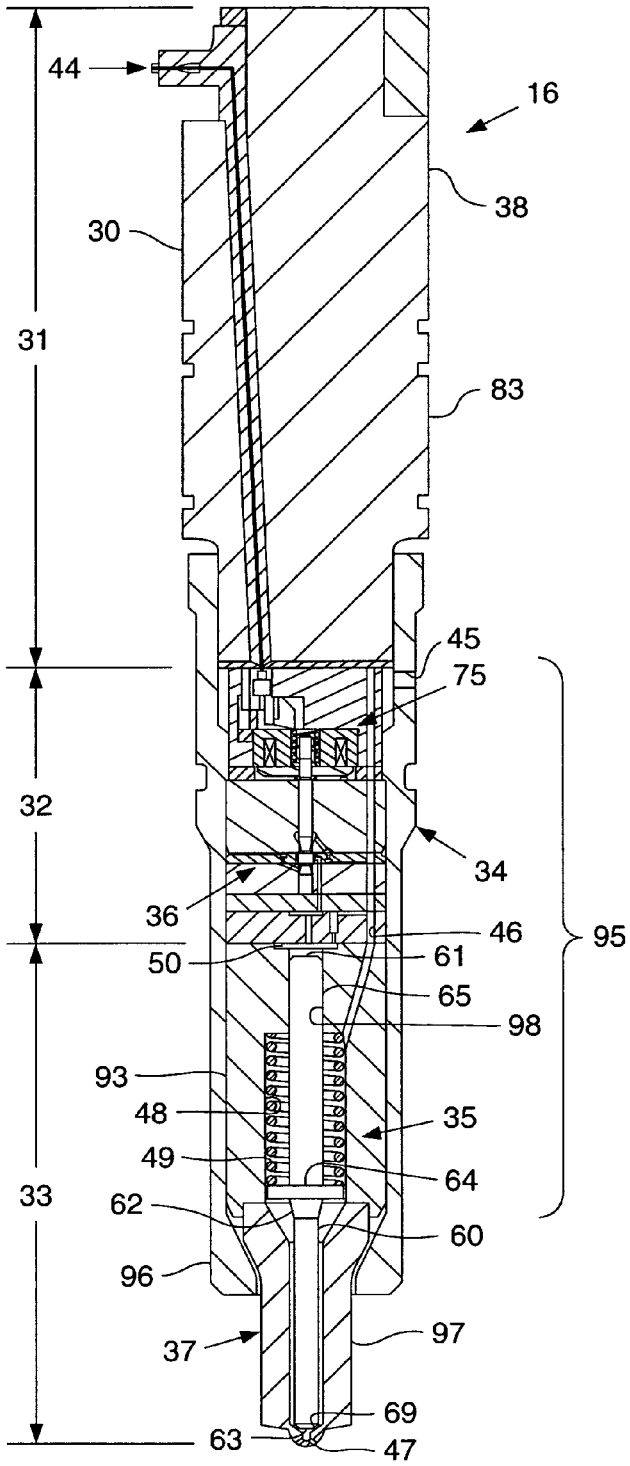
FIG. 2 is a front sectioned view of the fuel injector from the engine of FIG. 1.

Referring to FIG. 2, each fuel injector 16 can be thought of as having an injector body 30 that includes an upper portion 31, a middle portion 32 and a lower portion 33. Upper portion 31 includes an electrical connector 44, to which the communication line 22 of FIG. 1 is attached in a conventional manner. Current arriving at injector 16 is carried from connector 44 to the middle portion 32 via an electrical extension extending through injector body 30. The electrical extension includes a male or female electrical connector for connection of the same to an electrical actuator 75 located in middle portion 32. Middle portion 32 includes a needle control group 34, which includes electrical actuator 75 operably coupled to a needle control valve 36. Nozzle group 35 is located in lower portion 33.

When electrical actuator 75 is deenergized, as in between injection events, it is biased to a position that fluidly connects a needle control chamber 50 to fuel pressure in a nozzle supply passage 46. Nozzle supply passage 46 is connected via internal passageways within injector body 30 to a fuel inlet 38, which is connected to one of the branch passages 23 shown in FIG. 1. When electrical actuator 75 is energized, such as during an injection event, needle control chamber 50 is fluidly connected to low pressure fuel outlet 45 via a passage not shown. Fuel outlet 45 is connected to fuel tank 15 via drain passage 24, as shown in FIG. 1. A closing hydraulic surface 61 of a direct control needle valve member 60 is exposed to fluid pressure in needle control chamber 50.

Direct control needle valve member 60 is a portion of a nozzle group 35 which is located in lower portion 33 of fuel injector 16. Nozzle group 35 includes direct control needle valve 37, which includes a direct control needle valve member 60 that moves into and out of contact with a nozzle seat 69. When direct control needle valve member 60 is in contact nozzle seat 69, nozzle supply passage 46 is closed to nozzle outlet 47. When direct control needle valve member 60 is out of contact with nozzle seat 69, nozzle supply passage 46 is open to nozzle outlet 47, such that fuel can spray into the combustion space. Direct control needle valve member 60 is normally biased downward to a closed position by a biasing spring 49, which is located in a spring chamber 48. In this embodiment of the present invention, spring chamber 48 actually is a portion of nozzle supply passage 46, whereas in some of the other embodiments illustrated, and described infra, spring chamber 48 is separated from, but fluidly connected to, nozzle supply passage 46.

Direct control needle valve member 60 includes a first opening hydraulic surface 62 exposed to fluid pressure in spring chamber 48, and a second opening hydraulic surface 63, a portion of which is located below nozzle seat 69. This entire surface acts as an opening hydraulic surface when direct control needle valve member 60 is in its upward open position. In this embodiment, needle control chamber 50 is separated from spring chamber 48 by a guide bore 98. In the illustrated embodiment, direct control needle valve member 60 includes a single guide portion 65 that is located with a relatively close diametrical guide clearance in guide bore 98. Finally, direct control needle valve member 60 is formed to include a spring perch 64 against which biasing spring 49 bears.

Figure 3:
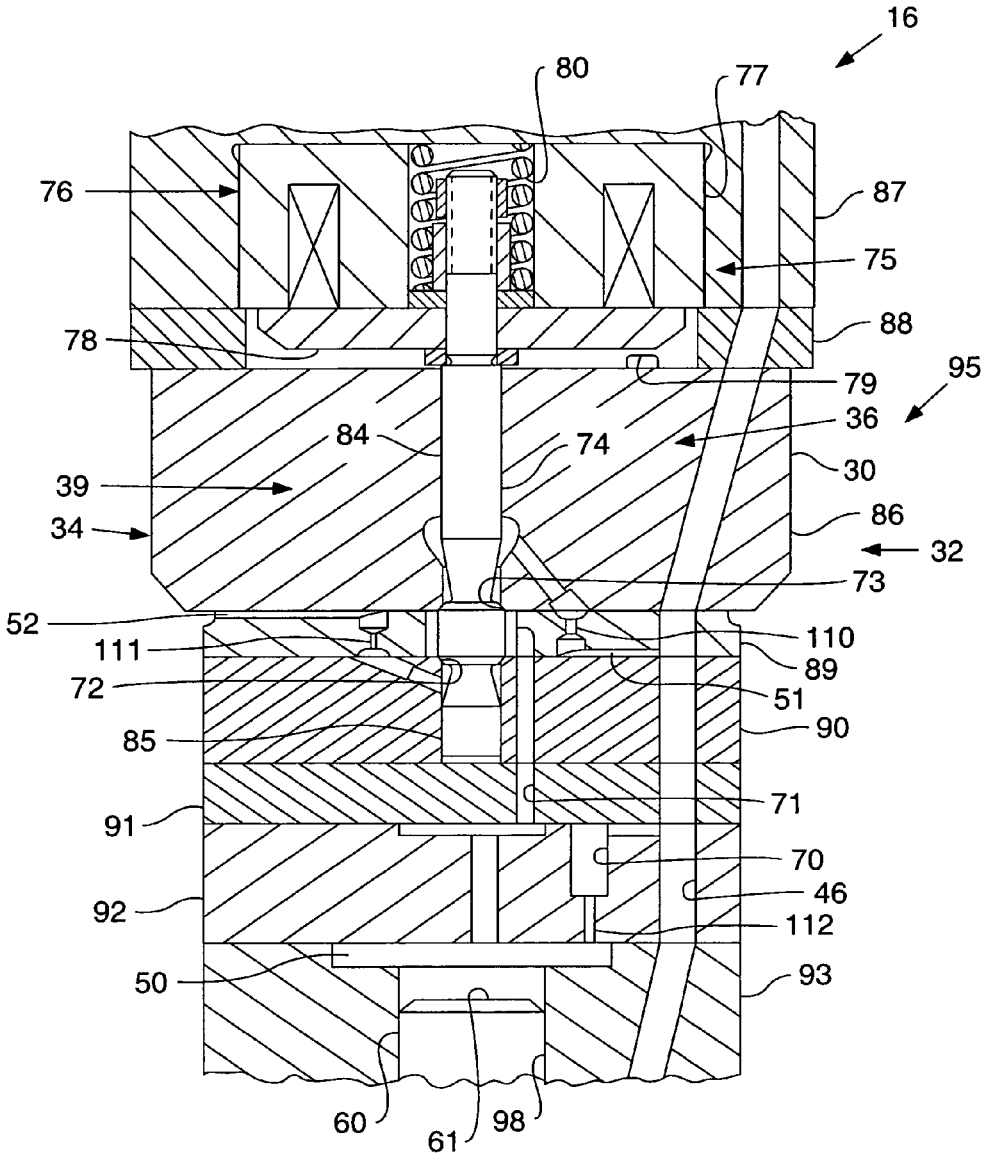
FIG. 3 is a partial sectioned front view of needle control group portion of the fuel injector shown in FIG. 2.

Fuel injector 16 preferably has a conventional structure in that it includes an injector stack 95 including a plurality of components stacked and compressed on top of one another by the threaded mating of upper body component 83 to casing 96 in a conventional manner. Referring in addition to FIG. 3, the injector stack 95 includes a carrier assembly 87, an air gap spacer 88, an upper seat component 86, a valve lift spacer 89, a lower seat component 90, a passage component 91, a pressure transfer component 92, a spring cage 93 and a tip 97. FIG. 3 is useful in illustrating the various components and passageways that are included as portions of the needle control group 34, which includes needle control valve 36. In this embodiment, needle control valve 36 is a three way valve 39. Nevertheless, those skilled in the art will appreciate that different aspects of the present invention are compatible with a two way valve, such as that shown in one or more of the succeeding embodiments.

Needle control valve 36 includes a control valve member 74 that is trapped to move between a first seat 72 and a second seat 73. Control valve member 74 is operably coupled to an electrical actuator 75, in a conventional manner. In the illustrated example actuator 75 is a solenoid 76, although other actuators could be substituted, including but not limited to voice coils, piezo stacks or benders, etc. In this example, control valve member 74 is attached to armature 78, which is separated from a stator assembly 77 by an air gap determined by the thickness of air gap spacer 88. Control valve member 74 is biased downward to a position in contact with first seat 72 by a biasing spring 80. The area around armature 78 is preferably vented to low pressure fuel outlet 45 (FIG. 2) via a vent opening 79. When control valve member 74 is in its downward biased position in contact with first seat 72, needle control chamber 50 is fluidly connected to high pressure in nozzle supply passage 46 via a control passage 71, past second seat 73 and through connection passage 51. When solenoid 76 is energized and control valve member 74 is lifted upward into contact with second seat 73, needle control chamber 50 is fluidly connected to fuel drain outlet 45 (FIG. 2) via control passage 71, past first seat 72 and through low pressure passage 52.

The travel distance of control valve member 74 is dictated by a thickness of valve lift spacer 89, which is preferably category thickness part like air gap spacer 88. In other words, these two parts preferably come in a range of thicknesses that allow the solenoid air gap and the valve travel distance, respectively, to be adjusted during assembly in order to provide uniformity in these geometrical features from one fuel injector to another. Connection passage 51 and low pressure passage 52 preferably include respective flow restrictions 110 and 111, which are preferably located in valve lift spacer 89 for ease of manufacture. Flow restrictions 110 and 111 are preferably restrictive to flow relative to a flow area across seats 73 and 72, respectively. By moving the flow restrictions in needle control valve 36 away from seats 72 and 73, flow forces on control valve member 74, which could undermine its performance, are reduced. In the illustrated embodiment, flow restriction 111 in low pressure passage 52 is preferably smaller than flow restriction 110 so that the opening rate of direct control needle valve member 60 can be slowed. This is accomplished since fluid in needle control chamber 50 must be displaced through flow restriction 111 when it lifts upward toward its open position.

Needle control chamber 50 is always, in this embodiment, connected to nozzle supply passage 46 via a separate pressure balancing passage 70 that includes still another flow restriction 112. Thus, when control valve member 74 is in its downward position closing seat 72, needle control chamber 50 is fluidly connected to nozzle supply passage 46 via pressure balancing passage 70 and via control passage 71. When control valve member 74 is in its upward position closing seat 73, needle control chamber 50 is fluidly connected to nozzle supply passage 46 via pressure balancing passage 70, and also connected to low pressure fuel drain outlet 45 (FIG. 2) via control passage 71 and low pressure passage 52. In order to allow for a pressure drop that would permit direct control needle valve member 60 to lift to its upward open position, flow restriction 112 is preferably more restrictive to flow than flow restriction 111. Thus, several relationships are present. Flow restriction 112 is more restrictive than flow restriction 111, which is more restrictive than flow restriction 110. Flow restrictions 110 and 111 are more restrictive to flow across seats 73 and 72, respectively.

Because nozzle supply passage 46 is always connected to the high pressure rail 14 (FIG. 1), control valve member 74 includes a relatively long guide portion 84 separating the high pressure fluid in the region around seat 73 from the low pressure surrounding armature 78. Thus, control valve member 74 is guided in upper seat component 30 via guide portion 84, which is elongated in order to substantially seal against fuel migration into the area around armature 78. Control valve member 74 also includes a relatively short guide portion 85 that is guided in lower seat component 90. This portion is shorter than guide portion 84 because, between injection events, there is no large pressure gradient between the area below seat 72 and the region underneath control valve member 74, which is vented to drain via a passage not shown.

Figure 4:
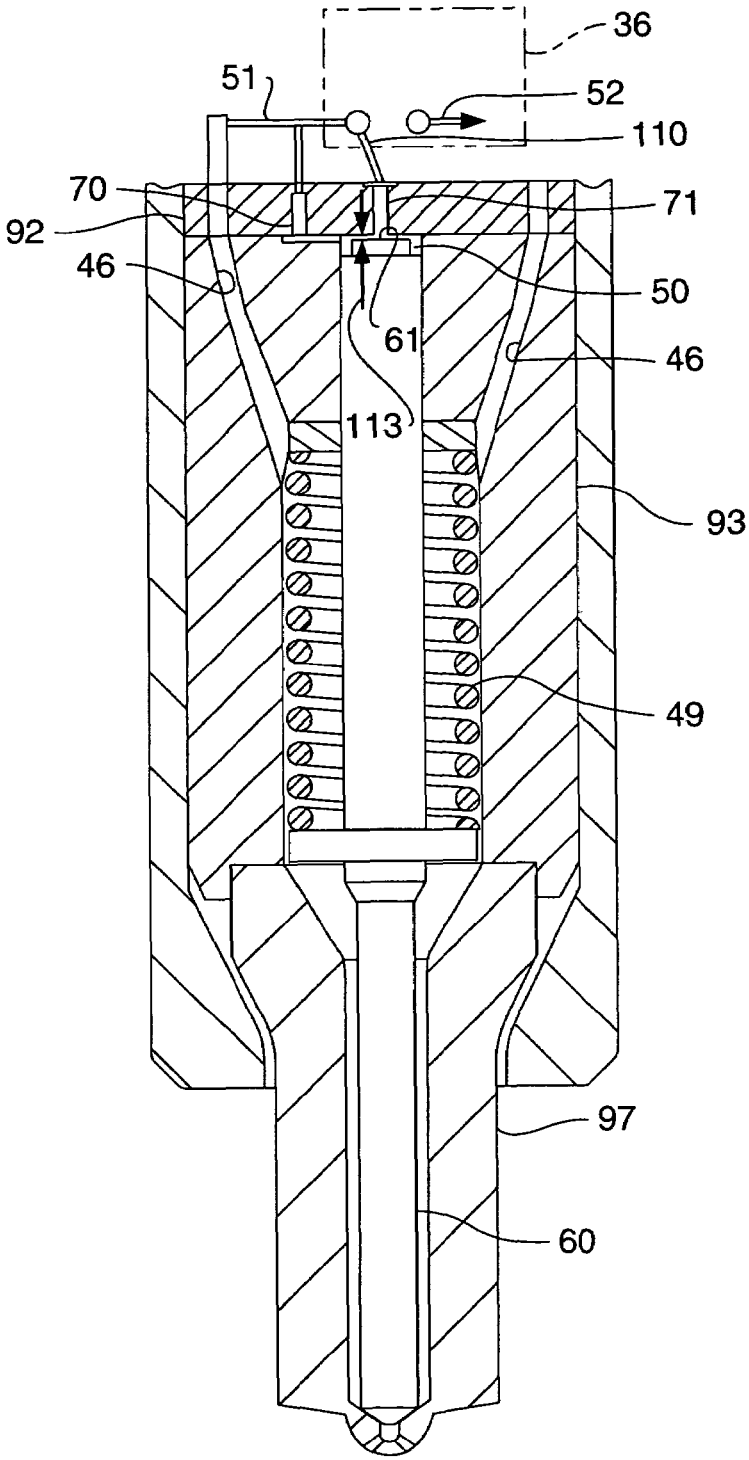
FIG. 4 is a schematic side sectioned view of the nozzle group portion of the fuel injector of FIG. 2 when the needle control valve is an off position.
Figure 5:
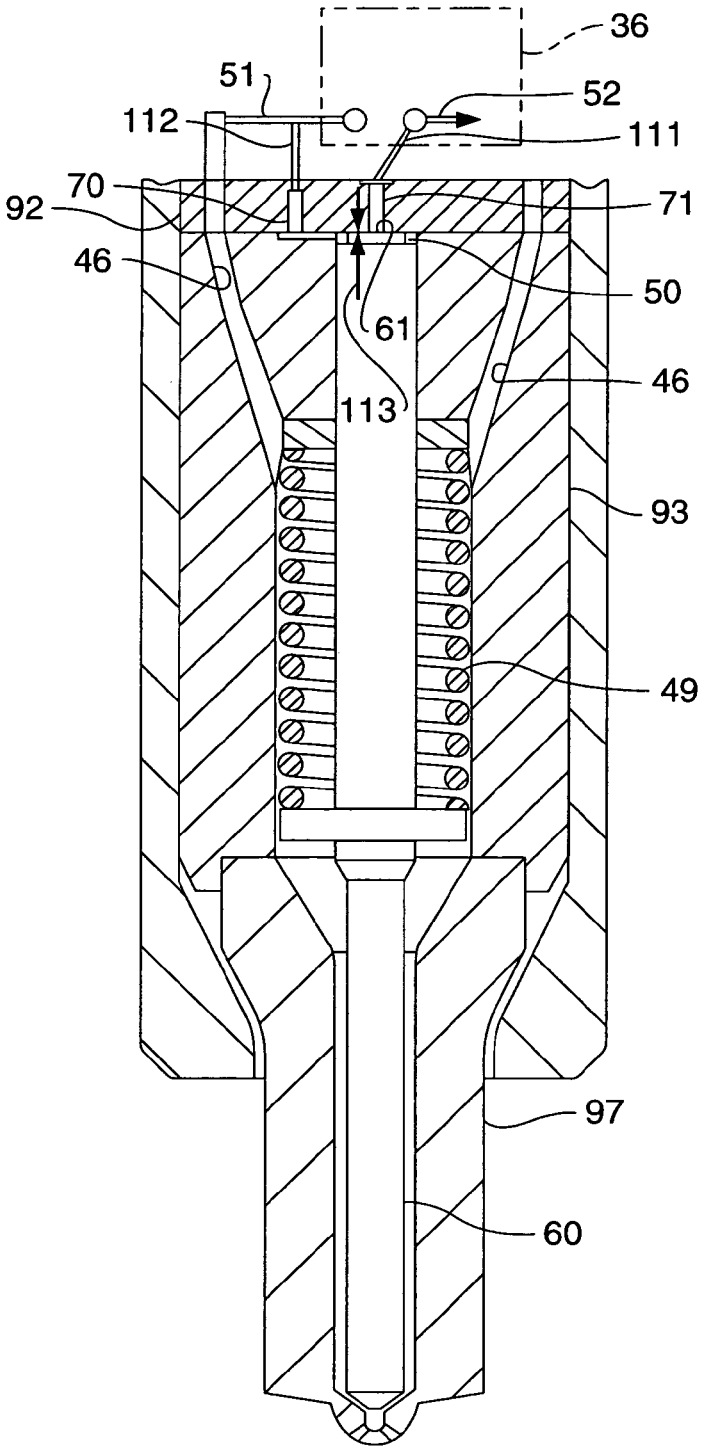
FIG. 5 is a schematic side view of the nozzle group when the needle control valve is in an on position.

Referring in addition to FIGS. 4 and 5, control passage 71 preferably opens into needle control chamber 50 in a way that can interact with the movement of direct control needle valve member 60 to produce a hydraulic stop, and illustrated in FIG. 5. Although this embodiment shows a hydraulic stop for direct control needle valve member 60, the present invention also finds applicability to direct control needle valve members with a mechanical stop, such as that shown in one or more of the succeeding embodiments. When direct control needle valve member 60 lifts toward its open position, closing hydraulic surface 61 moves closer and closer to blocking control passage 71 to needle control chamber 50. This movement is stopped when the gap 113 approaches the flow area through flow restriction 112, such that when direct control needle valve member 60 lifts beyond its equilibrium point, the flow past closing hydraulic surface 61 and into control passage 71 is more restricted than flow restriction 112 such that fuel pressure in needle control chamber 50 rises. As that pressure rises, direct control needle valve member 60 reverses direction and enlarges the gap 113. When that gap produces a flow area substantially larger than flow restriction 112, pressure in needle control chamber 50 again drops causing member 60 to again reverse directions. Eventually direct control needle valve member will come to an equilibrium position as shown in FIG. 5 after some dithering. In the illustrated example, gap 113 is about 665 micrometers when direct control needle valve member 60 is in its downward closed position as shown in FIG. 4, but about 15 micrometers when in its open position as shown in FIG. 5, such that member 60 has a lift distance on the order of about 650 micrometers, in the illustrated embodiment.

Figure 6:
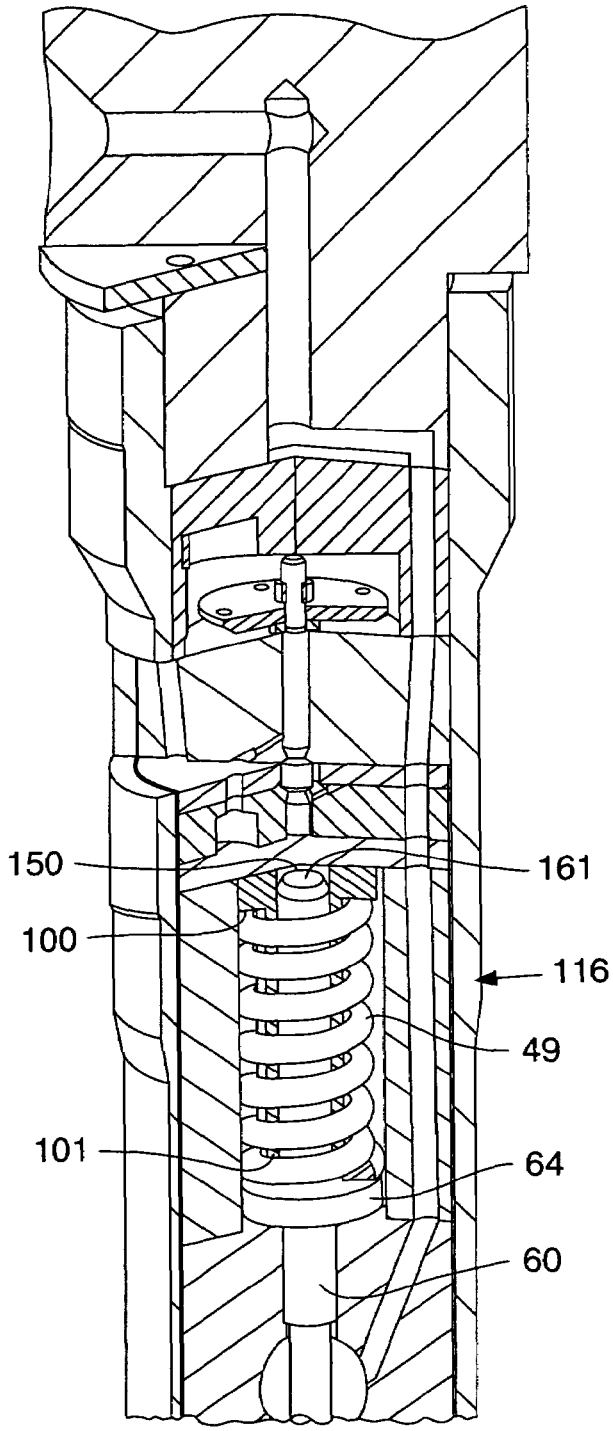
FIG. 6 is a partial sectioned front view of a fuel injector according to another aspect of the present invention.

Referring now to FIG. 6, a fuel injector 116 is substantially similar to fuel injector 16 described earlier except that it includes a needle control chamber 150 that is defined at least in part by a sleeve 100, against which spring 49 bears. Otherwise, fuel injector 116 is substantially identical to that of the earlier embodiment. This embodiment also differs in that it includes a mechanical stop verses the hydraulic stop of the previous embodiment. In particular, when direct control needle valve 60 lifts to its open position, spring perch 64 comes in contact with a stop surface 101 on sleeve 100. When direct control needle valve member 60 is in its downward closed position, spring perch 64 is out of contact with stop surface 101 of sleeve 100.

Figure 7:
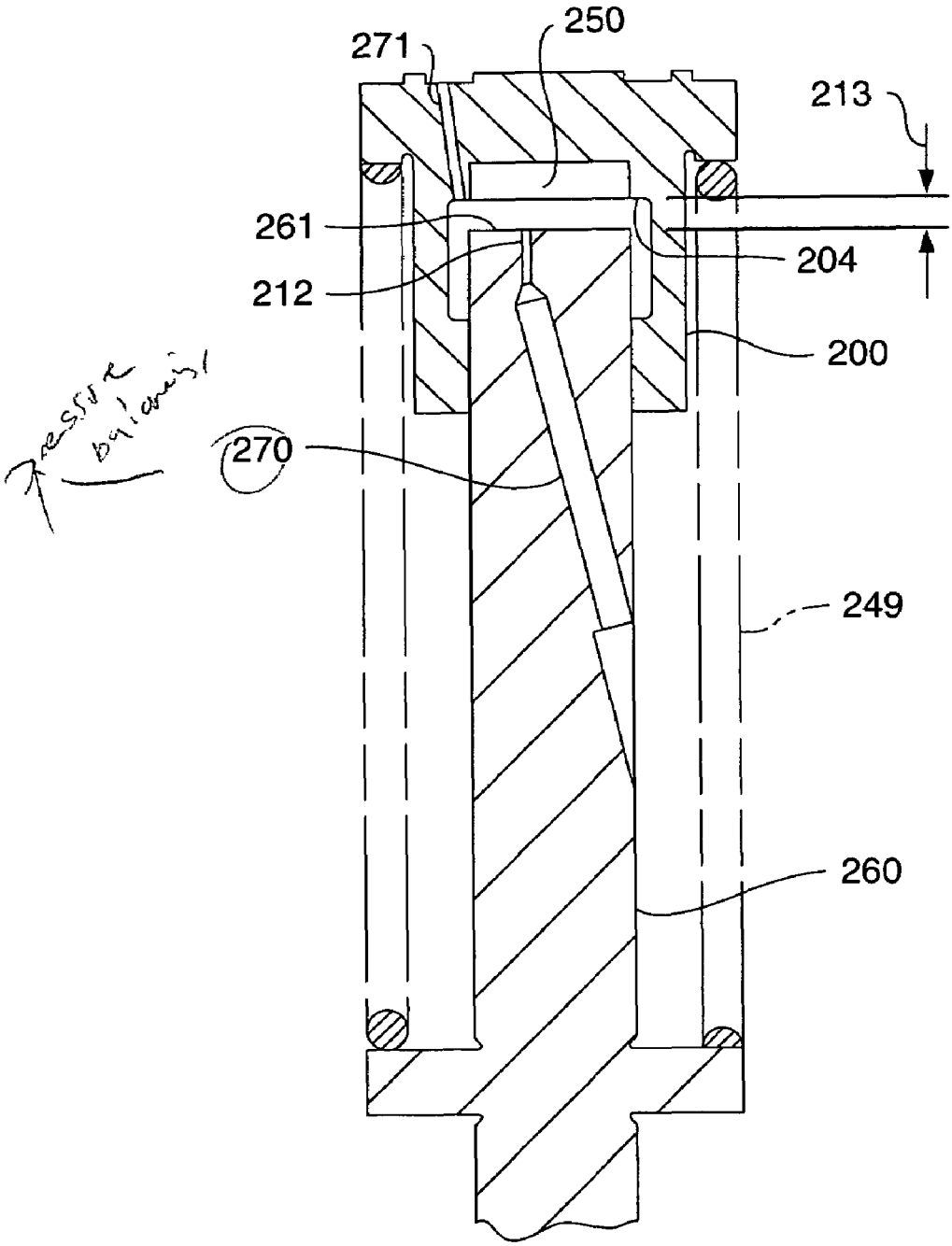
FIG. 7 is a partial side view of a direct control needle valve according to another aspect of the present invention.

Referring to FIG. 7, relevant portions of still another embodiment of the present invention are illustrated. This embodiment is similar to the previous embodiment in that it includes a sleeve 200, but is similar to the first embodiment in that it includes a hydraulic stop. Direct control needle valve member 260 is shown in its downward closed position such that gap 213 is relatively large. A needle control chamber 250 is connectable to either high or low pressure via a connection passage 271, but is always fluidly connected to a nozzle supply passage (not shown) via a pressure balancing passage 270, which in this embodiment is located through direct control needle valve member 260. Like the previous embodiments, direct control needle valve member 260 includes a closing hydraulic surface 261 exposed to fluid pressure in needle control chamber 250. Also like the previous embodiments, pressure balancing passage 270 includes a flow restriction 212, which is preferably more restrictive than any flow restriction located in control passage 271 or either of its high or low pressure connection passages. When direct control needle valve member 260 lifts upward, closing hydraulic surface 261 nearly comes in contact with an annular ledge 204, which separates the upper portion of needle control chamber 250 to control passage 271. Like the first embodiment, when closing hydraulic surface 261 comes near annular edge 204, pressure increases due to a high pressure supply by pressure balancing passage 270. When closing hydraulic surface 261 moves away from annular edge 204, pressure in needle control chamber 250 drops causing needle control valve member 260 to again reverse directions. Thus, when direct control needle valve member 260 is in its upward open position, it is close to but not quite in contact with annular edge 204. Like the previous embodiment, sleeve 200 is urged into contact with an injector stack component (not shown) via spring 249.

Figure 8:
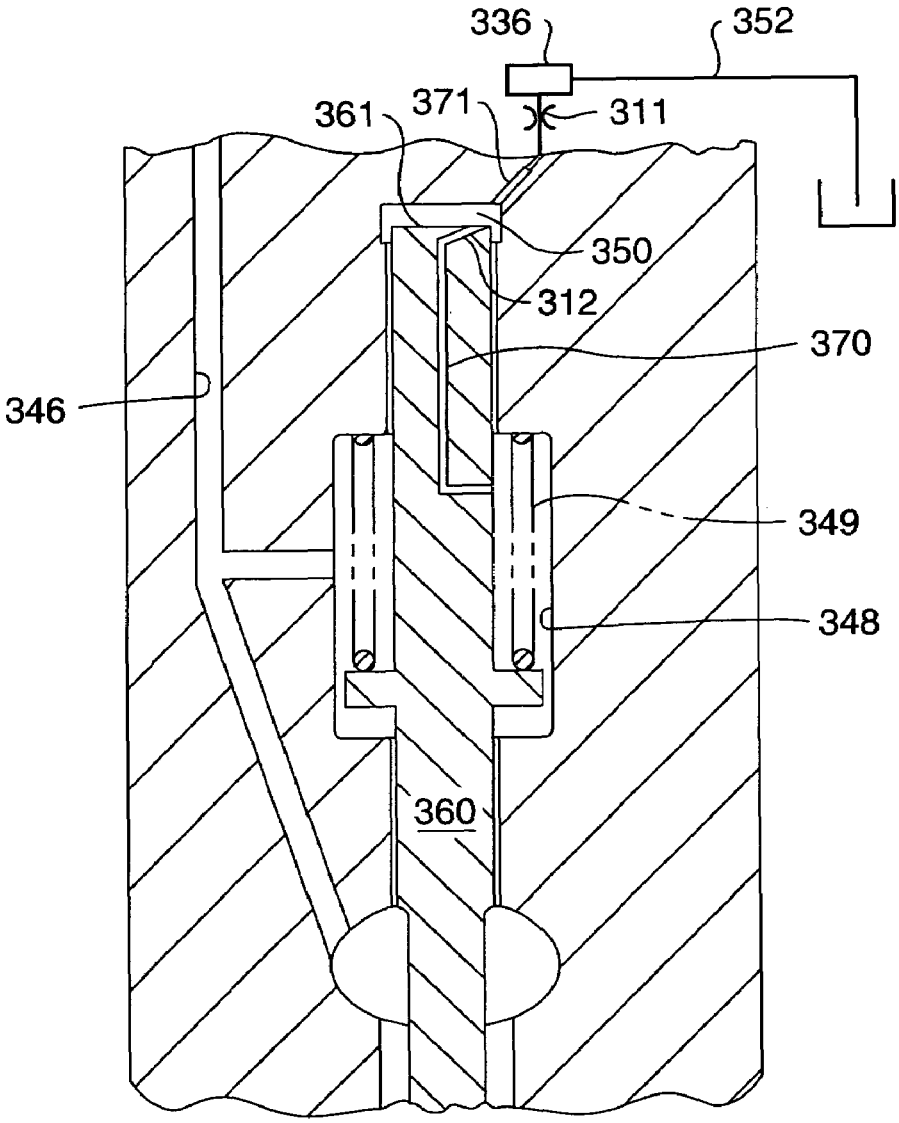
FIG. 8 is a partial schematic side view of a direct control needle valve and needle control valve according to another aspect of the present invention.

Referring to FIG. 8, still another embodiment of the present invention having a hydraulic stop is illustrated. Like the previous embodiment, the pressure balancing passage 370 is defined by the direct control needle valve member 360. This embodiment differs from the previous embodiments in that spring chamber 348 is separated from, but fluidly connected to nozzle supply passage 346. This embodiment also differs from the earlier embodiments in that control needle valve 336 is a two way valve, which either closes control passage 371 or opens the same to a low pressure passage 352. Like the previous embodiments, flow restrictions 311 and 312 are sized such that pressure drops in needle control chamber 350 when connection passage 371 is connected to low pressure passage 352. Preferably, control pressure passage 371 and/or pressure balancing passage 370 open into needle control chamber 350 with a geometry that produces the hydraulic stop phenomenon illustrated with respect to the embodiment shown in FIGS. 2-5 and FIG. 7.

Figure 9:
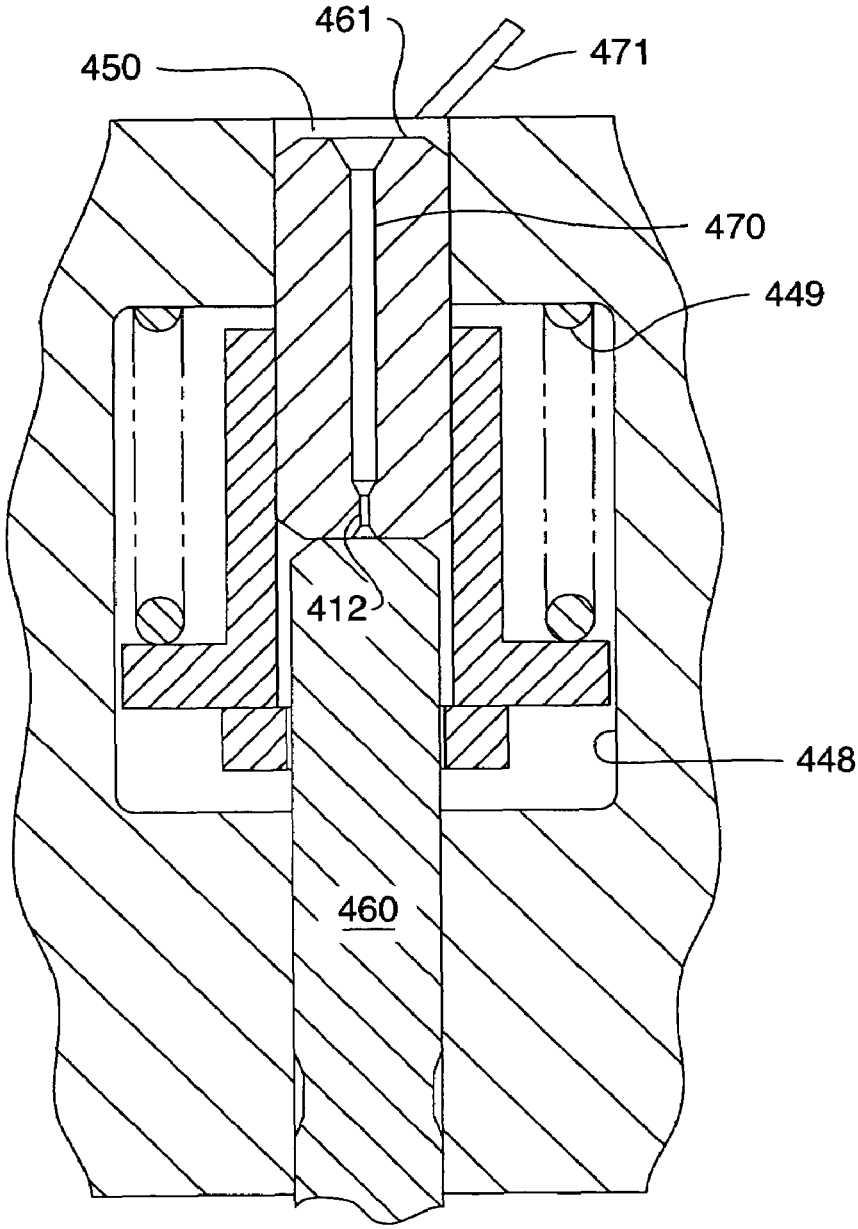
FIG. 9 is a schematic sectioned front view of a direct control needle valve and needle control valve according to another aspect of the present invention.

Referring to FIG. 9, still another embodiment of the present invention shows a direct control needle valve member 460 that includes two components that are not attached to one another. Like the previous embodiment, spring chamber 448 is fluidly connected to, but separated from, a nozzle supply passage (not shown). Also like the previous embodiment, pressure balancing passage 470 is defined by a portion of direct control needle valve member 460, and includes a flow restriction 412 as in the previous embodiments. Thus, needle control chamber 450 is preferably always fluidly connected to the high pressure rail via spring chamber 448 and pressure balancing passage 470. Needle control chamber 450 can also be fluidly connected to either high or low pressure via a three way valve (not shown) via control passage 471. As in the hydraulically stopped embodiments previously described, pressure balancing passage 470 and/or control passage 471 open into needle control chamber 450 in a way that movement of direct control needle valve member 460 has a valving effect in order to produce the hydraulic stop phenomenon described previously.

Figure 10:
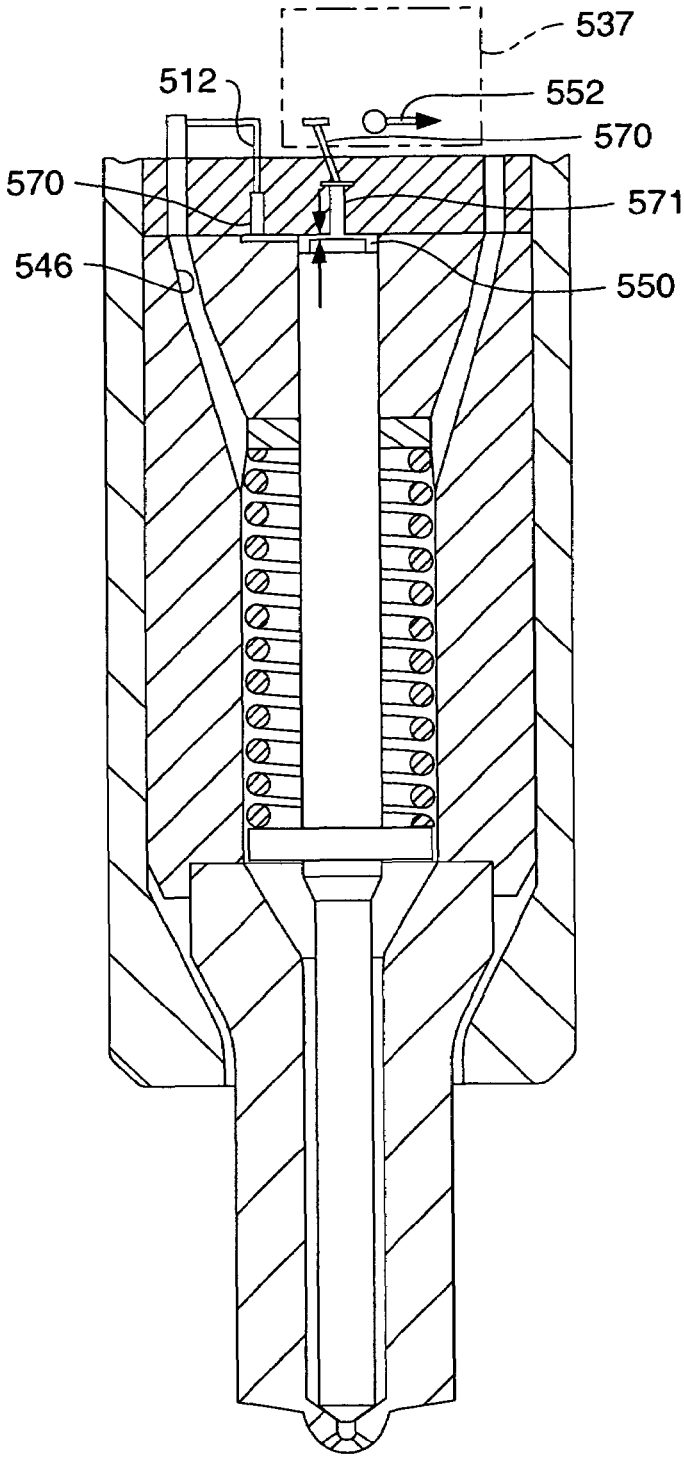
FIG. 10 is a partial schematic side view of the nozzle group portion of a fuel injector according to still another aspect of the present invention when the needle control valve is in an off position.
Figure 11:
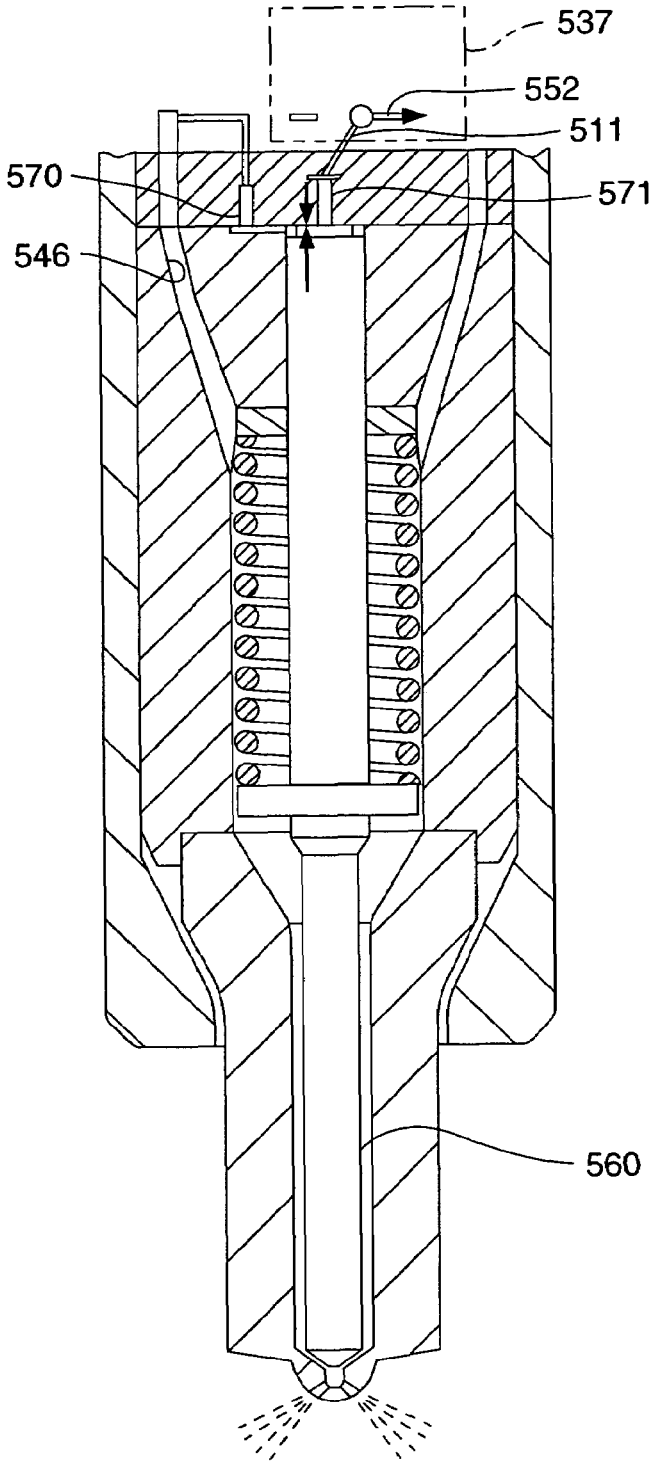
FIG. 11 is a schematic sectioned front view of the fuel injector of FIG. 10 when the needle control valve is in an on position.

Referring now to FIGS. 10 and 11, an embodiment is illustrated that is substantially identical to the embodiments shown in FIGS. 2-5 except that the three way control valve 39 of FIGS. 2-5 has been replaced with a two way valve 537. Thus, when two way needle control valve 537 is in its off position as shown in FIG. 10, the needle control chamber 550 is fluidly connected to nozzle supply passage 546 via pressure balancing passage 570, which includes flow restriction 512. When two way needle control valve 537 is moved to its on position as shown in FIG. 11, needle control chamber 550 is fluidly connected to drain via control passage 571 and low pressure passage 552. Because flow restriction 512 is more restrictive to flow than flow restriction 511, pressure can drop in needle control chamber 550 to allow direct control needle valve member 560 to move upward toward its open position as shown in FIG. 11. This embodiment also includes the hydraulic stop features of the earlier embodiments.

INDUSTRIAL APPLICABILITY

Referring to the figures, each injection event begins by energizing electrical actuator 75 to move the needle control valve 36, 336 from an off position to an on position. Before being energized, the needle control valve 36, 336 was in its biased off position that exposed closing hydraulic surface 61, 161, 261, 361, 461 of direct control needle valve member 60, 160, 260, 360, 460, 560 to high pressure fuel in the needle control chamber 50, 150, 250, 350, 450, 550. When moved to its on position, closing hydraulic surface 61, 161, 261, 361, 461 is exposed to low pressure fuel in needle control chamber 50, 150, 250, 350, 450, 550. With regard to the three way valve embodiments, this is accomplished by connecting needle control chamber 50, 150, 250, 450 to low pressure passage 52 via control passage 71, 271, 471. Because flow restriction 111 is less restrictive than flow restriction 112, pressure in needle control chamber 50 will drop to a level that allows the fuel pressure acting on opening hydraulic surface 62 to overcome the bias of spring 49. As direct control needle valve member 60 begins to lift, fluid continues to enter needle control chamber 50 through flow restriction 112 but is being drained even faster through control passage 71 into low pressure passage 52 past flow restriction 111. Those skilled in the art will appreciate that, by adjusting the relative sizes of flow restrictions 111 and 112, the opening rate of the direct control needle valve member 60 can be slowed in order to cause the initial fuel injection rate to rise gradually. Each injection event is ended by deenergizing electrical actuator 75, allowing needle control valve 36 to move to its off position that closes low pressure passage 52 to needle control chamber 50. When this occurs, pressure rapidly rises in needle control chamber 50 causing direct control needle valve member 60 to move downward to its closed position to end the injection event.

Although not necessary, the present invention preferably includes a pressure balanced direct control needle valve member 60. The term pressure balanced is intended to mean that the effective area of closing hydraulic surface 61 is about equal to the combined effective area of first opening hydraulic surface 62 and second opening hydraulic surface 63. In other words, when direct control needle valve member 60 is in its upward open position, and both needle control chamber 50 and spring chamber 48 are at the same pressure, the only force acting on direct control needle valve member 60, is from biasing spring 49. This pressure balancing strategy is easily accomplished in the preferred embodiment by including a single guide region 65 on direct control needle valve member 60 that has a uniform diameter, resulting in equal effective surface areas above and below guide portion 65. By utilizing a pressure balanced direct control needle valve member 60, various other features are more easily sized in order to cause fuel injector 16 to perform as desired. For instance, the preload on spring 49 determines the rate at which direct control needle valve 35 will close. Those skilled in the art will appreciate that, although desirable, a pressure balanced direct control needle valve member is not necessary for the present invention. In other words, non pressure balanced direct control needle valve members could fall within the intended scope of the present invention.

With regard to efficiency, those skilled in the art familiar with many production common rail fuel injectors will appreciate that usually two major static leakage sources exist. First, the needle guide and secondly the needle push rod guide. During injector off time, both of these guides are exposed to injection rail pressure on one end with a vent to tank fuel pressure on the other end, which is typically located in a spring chamber that contains the spring biases the needle valve member toward its closed position. Extreme measures are often employed to minimize the clearance to reduce static leakage. As the desired operating pressure levels are increased, the leakage problem becomes more and more severe, as pressure induced deflections in the guide bores add to an already difficult situation. The present invention addresses this problem by fluidly connecting the spring chamber to rail pressure so that no large pressure gradients exist across any guide regions associated with the direct control needle valve member. This avoids any need to take extreme measures in providing overly tight clearances in the guide region(s) for the direct control needle valve member, and also boosts efficiency by avoiding any substantial fuel leakage back to tank over the relatively long duration between injection events when the injector is off but remains fully pressurized. In the preferred embodiment, a three way control valve is used so that the closure rate of direct control needle valve member 60 can be hastened over that likely possible with a two way control valve as illustrated in relation to the embodiment shown in FIG. 8 and FIGS. 10 and 11. In the case of the two way control valve, needle control chamber 50 must be repressurized by fuel passing through flow restriction 312, 512, which inherently must be more restrictive than the flow restriction in the low pressure drain passage. In the case of the three way valve, the needle control chamber 50 can be repressurized via both control passage 71 and pressure balancing passage 70. Although both two way and three way needle control valves are compatible with the present invention, some static fuel leakage issues around the needle control valve should be addressed. In most instances, it is desirable that the area around the electrical actuator coupled to the needle control valve not be continuously exposed to high pressure fuel. The consequence being that both ends of a needle control valve member 74 are always exposed to low pressure. This potential static leakage has been addressed in the present invention by lengthening the guide portion 84 that separates electrical actuator 75 from the high pressure fluid adjacent seat 73.

From the previously illustrated embodiments, those skilled in the art will appreciate that the present invention finds potential application in direct control needle valves that include either a hydraulic stop or a mechanical stop. Although the present invention finds preferred application in common rail systems in which the fuel injector remains pressurized between injection events, it could find potential application in virtually any type of fuel injector, including but not limited to hydraulically actuated fuel injectors, pump and line fuel injection systems and cam actuated fuel injectors. In these examples, static fuel leakage is ordinarily not a substantial problem due to the fact that the injectors are generally at low pressure between injection events. In any event, the present invention preferably reduces static leakage around the direct control needle valve member by surrounding the member above the nozzle seat with high pressure fuel from the common rail between injection events.

The present invention preferably, but not necessarily, utilizes a hydraulic stop, which inevitably leads to some fuel leakage during each injection event. When a hydraulic stop is employed, the rail is connected directly to the low pressure drain through the needle control chamber during the injection event. This leakage for the purposes of the control function is managed by the inclusion of a flow restriction that reduces the amount of fuel leakage or spillage necessary to perform the direct control needle valve hydraulic stop function. This type of leakage during injection events could be substantially reduced or eliminated by employing a mechanical stop. However, when the direct control needle valve member comes in contact with a stop, the fluid pressure forces acting on the needle can become less predictable because the mechanical stop contact area can alter the expected pressure forces acting on the direct control needle valve member. This can possibly even be to the extent that it is difficult to close the needle in a desired manner and/or at a desired rate. This potential issue can become more profound after the injector is broken in after many injection events due to the repeated contact and pounding between the direct control needle valve member and its stop. Using a hydraulic stop avoids these issues but often requires close attention to sizing of the various flow restrictions that are associated with the needle control chamber 50, as well as the position of the same relative to the direct control needle valve member, which essentially acts as a valve in partially closing the control passage 71 when in its open position. Locating the needle control valve in close proximity to the direct control needle tends to increase hydraulic stiffness, avoids excess inertia and can improve controllability.

Those skilled in the art will appreciate that that various modifications could be made to the illustrated embodiment without departing from the intended scope of the present invention. Thus, those skilled in the art will appreciate the other aspects, objects and advantages of this invention can be obtained from a study of the drawings, the disclosure and the appended claims.

What is claimed is:

1. A fuel injector comprising:

an injector body including a nozzle supply passage always in fluid communication with a needle control chamber via a pressure balancing passage, and the needle control chamber being fluidly connected to a control passage;

a direct control needle valve movably positioned in said injector body to open and close a nozzle outlet, and including a closing hydraulic surface exposed to fluid pressure in the needle control chamber and movable to a position that interacts with the control passage to produce a hydraulic stop when the direct control needle valve is in an open position; and a needle control valve attached to said injector body, and including a valve member trapped to move between a low pressure seat corresponding to an off position at which the needle control chamber is fluidly disconnected from a low pressure passage to expose the closing hydraulic surface to high pressure fuel in said needle control chamber, and a high pressure seat corresponding to an on position fluidly connecting the needle control chamber to a low pressure passage to expose said closing hydraulic surface to low pressure fuel in said needle control chamber.

2. The fuel injector of claim 1 including a spring operably positioned in a spring chamber to bias said direct control needle valve toward a closed position; and the spring chamber is a portion of the nozzle supply passage.

3. The fuel injector of claim 1 wherein the high pressure seat separates the nozzle supply passage from the needle control chamber, and the low pressure seat separates the low pressure passage from the needle control chamber.

4. The fuel injector of claim 1 wherein the needle control chamber is fluidly connected to the nozzle supply passage via the control passage past the valve member, and via the pressure balancing passage, which is different from the control passage.

5. The fuel injector of claim 1 wherein said needle control chamber is defined at least in part by a sleeve biased into contact with an injector stack component by a spring.

6. The fuel injector of claim 1 wherein the needle control chamber is separated from a spring chamber by a needle guide bore defined by a compressed injector stack component; and the needle valve member includes a single guide region located in said needle guide bore.

7. A fuel injection system comprising:

a common rail containing high pressure fuel;

a plurality of fuel injectors fluidly connected to said common rail;

each of the fuel injectors including a needle control chamber fluidly connected to a control passage, and further including a needle control valve, a direct control needle valve member with a closing hydraulic surface exposed to fluid pressure in the needle control chamber and movable to a position that interacts with the control passage to produce a hydraulic stop when the direct control needle valve member is in an open position, and the needle control chamber being always fluidly connected to a nozzle supply passage via a pressure balancing passage;

the needle control valve including a valve member trapped to move between a low pressure seat corresponding to an off position at which the needle control chamber is fluidly disconnected from a low pressure passage to expose the closing hydraulic surface to high pressure fuel in said needle control chamber, and a high pressure seat corresponding to an on position fluidly connecting the needle control chamber to a low pressure passage to expose said closing hydraulic surface to low pressure fuel in said needle control chamber.

8. The fuel injection system of claim 7 wherein each of the fuel injectors includes a spring operably positioned in a spring chamber to bias said direct control needle valve toward a closed position; and the spring chamber is a portion of the nozzle supply passage.

9. The fuel injection system of claim 7 wherein the high pressure seat separates the nozzle supply passage from the needle control chamber, and the low pressure seat separates the low pressure passage from the needle control chamber.

10. The fuel injection system of claim 7 wherein the needle control chamber is fluidly connected to the nozzle supply passage via the control passage past the valve member, and via the pressure balancing passage, which is different from the control passage.

11. The fuel injection system of claim 7 wherein said needle control chamber is defined at least in part by a sleeve biased into contact with an injector stack component by a spring.

12. The fuel injection system of claim 7 wherein the needle control chamber is separated from a spring chamber by a needle guide bore defined by a compressed injector stack component; and the needle valve member includes a single guide region located in said needle guide bore.

13. A method of operating a fuel injector, comprising the steps of:

moving a needle control valve toward a position that exposes a closing hydraulic surface of a direct control needle valve member to low pressure fuel while an opening hydraulic surface is exposed to high pressure fuel;

moving the direct control needle valve member away from a closed position to open a nozzle outlet and toward a position that blocks fluid communication between a needle control chamber and a low pressure passage;

hydraulically stopping the direct control needle valve member before reaching the position that blocks fluid communication between a needle control chamber and a low pressure passage via an interaction between the direct control needle valve member and the low pressure passage; and moving the needle control valve from contact with a high pressure seat to contact with a low pressure seat to end an injection event.

14. The method of claim 13 including a step of always maintaining a fluid connection between the needle control chamber and a nozzle supply passage via a pressure balancing passage.

15. The method of claim 13 including a step of moving the needle control valve toward a position that fluidly connects the needle control chamber to the nozzle supply passage via a control passage separate from the pressure balancing passage.

16. The method of claim 13 including a step of biasing a sleeve into contact with an injector stack component by a spring to define the needle control chamber.

17. The method of claim 13 including a step guiding the direct control needle valve member with a single guide region located between the closing hydraulic surface and a spring chamber.

18. The method of claim 17 including a step of surrounding a portion of the direct control needle valve above a nozzle seat with high pressure fuel from a common rail between injection events.

* * * * *